United States Patent [19]

Bonaventure

[11] Patent Number: 5,054,213

[45] Date of Patent: Oct. 8, 1991

[54] ALPINE SKI BOOT WITH SHOCK ABSORBING SOLE

[75] Inventor: Laurent Bonaventure, Annecy, France

[73] Assignee: Salomon S.A., Pringy, France

[21] Appl. No.: 480,595

[22] Filed: Feb. 15, 1990

Related U.S. Application Data

[62] Division of Ser. No. 150,202, Jan. 29, 1988, Pat. No. 4,937,955.

[30] Foreign Application Priority Data

Feb. 12, 1987 [FR] France ..... 87 02175

[51] Int. Cl.[5] ..... A43C 13/08; A43B 5/04

[52] U.S. Cl. ..... 36/117; 36/132; 280/613

[58] Field of Search ..... 36/117-121, 36/132, 36, 28; 280/611, 613, 614, 615, 623

[56] References Cited

U.S. PATENT DOCUMENTS

| | | | |
|---|---|---|---|
| 1,977,693 | 10/1934 | Page | 36/28 X |
| 2,184,456 | 12/1939 | Knapp | 36/28 X |
| 2,449,294 | 9/1948 | Guindon | 36/2.5 |
| 3,925,911 | 12/1975 | Erlebach | 36/2.5 |
| 3,990,159 | 11/1976 | Borgeas | 36/28 X |
| 3,992,789 | 11/1976 | Dikoff | 36/117 |
| 4,078,322 | 3/1978 | Dalebout | 36/121 |
| 4,316,332 | 2/1982 | Giese et al. | 36/28 |
| 4,351,120 | 9/1982 | Dalebout | 36/117 |
| 4,378,642 | 4/1983 | Light et al. | 36/35 R X |
| 4,417,408 | 11/1983 | Metro | 36/36 R |
| 4,499,674 | 2/1985 | Olivieri | 36/117 |
| 4,597,195 | 7/1985 | Dananberg | 36/28 |
| 4,619,059 | 10/1986 | Koniuk | 36/132 |
| 4,697,361 | 10/1987 | Ganter et al. | 36/28 |

FOREIGN PATENT DOCUMENTS

| | | |
|---|---|---|
| 152017 | 8/1985 | European Pat. Off. . |
| 250021 | 12/1987 | European Pat. Off. . |
| 1111063 | 7/1961 | Fed. Rep. of Germany . |
| 2431692 | 1/1975 | Fed. Rep. of Germany . |
| 2639167 | 3/1978 | Fed. Rep. of Germany . |
| 8008224 | 3/1980 | Fed. Rep. of Germany . |
| 3321847 | 12/1983 | Fed. Rep. of Germany . |
| 1461743 | 11/1966 | France . |
| 2556569 | 6/1985 | France . |
| 172710 | 1/1935 | Switzerland . |
| 490032 | 6/1970 | Switzerland . |
| 549969 | 6/1974 | Switzerland . |
| 587032 | 4/1977 | Switzerland . |

*Primary Examiner*—Paul T. Sewell
*Assistant Examiner*—Ted Kavanaugh
*Attorney, Agent, or Firm*—Sandler, Greenblum & Bernstein

[57] ABSTRACT

A shock-absorbing sole for a ski boot. The sole of the ski boot includes at least one elastically deformable element and at least one stiffener, which together comprise the shock absorption apparatus of the invention. The stiffener gives the sole its necessary rigidity for cooperation with the ski bindings. The elastically deformable element, on the other hand, absorbs forces that are encountered during skiing. The shock absorption apparatus can be included in a removable end plate so that the elastically deformable elements can be conveniently replaced to thereby permit the skier to insert an element having the properties he desires. The elastically deformable elements can be either flush with the lower surface of the sole or, alternatively, can be sandwiched within the thickness of the sole. The elastically deformable element can be arranged only on the exterior side or, alternatively, only on the interior side of the sole of the ski boot to thereby cushion forces that are generally encountered to a greater degree during turns. The stiffeners can be arranged either coaxially with the longitudinal axis of the sole of the ski boot, or they can be parallel, yet offset from the longitudinal axis boot to thereby effect an asymmetrical arrangement. Alternatively, the stiffener can be located angularly to the longitudinal axis of the sole of the ski boot to thereby give the sole of the ski boot more rigidity with regard to forces encountered which are oblique to the longitudinal axis of the ski boot.

29 Claims, 10 Drawing Sheets

ALPINE SKI BOOT WITH SHOCK ABSORBING SOLE

This is a division of application Ser. No. 07/150,202 filed Jan. 29, 1988, now U.S. Pat. No. 4,937,955.

BACKGROUND OF THE INVENTION

1. Field of the Invention

The present invention relates to boot soles and more particularly to alpine ski boot soles.

2. Description of Background and Relevant Information

In a manner which is known in itself, boots comprise a walking sole on which is affixed a vamp, also known as the upper of a boot. For certain purposes, in the field of sports, the walking sole can have different types of structure which are more or less sophisticated, having properties of rigidity, flexibility, shock-absorption, etc. One can cite, by way of example, the walking shoes described in French Patent No. 1,461,743 or German Patent No. 33 21 847, which shoes comprise shock absorbing soles. French Patent No. 1,461,743 teaches in particular a boot whose sole has an insulating hollow structure, which is elastically deformable over only a portion of the walking surface. This structure guarantees a support which is uniformly distributed over the foot in the boot whatever the unevenness of the ground. By way of comparison, German Patent No. 33 21 847 describes one type of shoe in which the shock absorbing sole, extending over the entire walking surface has a deformable structure which substantially modifies the foot retention conditions of the boot.

U.S. Pat. No. 4,619,059, relates to a walking shoe adaptable to ski boots and adapted to be deformed on the side of the walking surface as a function of the unevenness of the ground and of the relative support position on the ground.

The different types of soles described above are not adapted to be utilized on shoes adapted for alpine skiing by virtue both of their lack of rigidity and their excessive coefficient of friction, which renders them incompatible with the retention means of the boot on the ski, commonly referred to as ski bindings, which must themselves satisfy release conditions dictated by safety standards. Thus, these alpine ski boots generally comprise an upper constituted by a shell base whose sole satisfies safety standards and is obtained by molding of a relatively rigid plastic material. Each of the ends of the sole of these boots is thus adapted to come into contact with the bindings of the ski along cooperation zones having dimensional characteristics and a coefficient of friction prescribed by the normalized standards of this type of sport shoe or boot.

Thus, while most of the sport boots must be flexible and offer good shock absorption for the foot with respect to the ground, alpine ski boots must be provided with rigid soles, making it possible to obtain a firm support for the foot which is adapted to guarantee the optimum steering precision of the skis by means of the instantaneous relay of impulses cf the foot of the skier. Furthermore, for the safety reasons explained above, the soles of alpine ski boots must be adapted, at least for the cooperation zones with the bindings, from rigid materials, which resist abrasion and, according to dimensional characteristics, are adapted to satisfy all safety release conditions defined by international standards. However, by virtue of their rigidity and established dimensional constraints, soles of alpine ski boots have a notorious absence of shock absorption. During skiing, the nature of the terrain and the speed of the skier cause a variety of shocks, which are brutally and totally relayed from the ski to the foot of the skier by means of the sole. The forces caused by these shocks, being for the most part directed toward the plane of the sliding surface of the ski, thus create the same number of impact points on the ski, and thus on the sole of the boot, modifying the control conditions and consequent balancing by the skier. Thus, the steering of the skis is itself subjected to forces which are all the more increased and numerous as the skier reaches substantial speeds.

SUMMARY OF THE INVENTION

It is an object of the invention to provide a ski boot having a sole including at least one zone which is adapted to cooperate with the support plates of a binding wherein, at least in the cooperation zone, the sole includes a shock absorption apparatus located within the thickness of said sole. The shock absorption apparatus, according to the invention, includes at least one rigid rib having a dimension less than that of the width of the sole, and at least one elastically deformable insert positioned in a corresponding cut-out adjacent to the rib. The cooperation zone can be positioned in a front and/or a rear portion of the sole.

The elastically deformable insert in one embodiment is a compressible element encased in the sole which has a surface substantially flush with the walking surface of the sole of the ski boot.

The elastically deformable insert in a second embodiment is a compressible element wedged within the thickness of the sole such that between the compressible element and the walking surface the sole is elastically deformable.

In one embodiment of the ski boot of the invention, the elastically deformable insert is situated only on the internal side of the ski boot.

In a further embodiment, at least one elastically deformable insert extends on each side of the rigid rib.

In a still further embodiment, two elastically deformable inserts are symmetrically positioned relative to the rigid rib.

In a still further embodiment, two elastically deformable inserts are asymmetrically positioned relative to the rigid rib.

In a still further embodiment, a larger elastically deformable insert is situated on the internal side of the ski boot than one on the external side of the ski boot.

In a still further embodiment, a larger elastically deformable insert is situated on the external side of the ski boot than on the internal side of the ski boot.

A further aspect of the invention includes a removable end plate attached to the ski boot having a shock absorption apparatus provided either in its thickness or flush with its lower surface.

The invention can also be characterized as the sole of a ski boot which includes at least one stiffener and at least one elastically deformable element which is laterally adjacent the stiffener, whereby the stiffener defines the thickness of said sole under all conditions encountered during skiing, and whereby the elastically deformable element is adapted to deform and thereby absorb forces encountered during skiing. The elastically deformable element of the invention is located in a front support zone or a rear support zone or both.

According to one embodiment, the elastically deformable element extends substantially the entire length of the sole.

According to a further embodiment, the elastically deformable element extends to the edge of the sole.

According to a still further embodiment, the elastically deformable element further is substantially flush with the lower surface of the sole.

According to a still further embodiment, the elastically deformable element is located within the sole and the sole further includes a flexible and/or deformable portion located between the lower surface and the elastically deformable element.

According to a still further embodiment, the elastically deformable element is located only on the internal or only on the external side of the sole.

According to a still further embodiment, the longitudinal axis of a single stiffener is coaxial with the longitudinal axis of the sole.

According to a still further embodiment, an elastically deformable element is included on either lateral side of a single stiffener.

According to a still further embodiment, the sole includes a lower surface, wherein a first elastically deformable element includes a surface which is flush with the lower surface, wherein the sole further has a first thickness, wherein a second elastically deformable element has a second thickness less than the first thickness, whereby the second elastically deformable element is located within the sole and whereby the sole further includes a portion located between said lower surface and the second elastically deformable element which portion is deformable and/or flexible.

According to a still further embodiment, the longitudinal axis of the sole is not coaxial with the longitudinal axis of the stiffener, but can be either parallel or oblique thereto. In any case, an elastically deformable element can be provided on either lateral side of the stiffener or, alternatively, on only one lateral side of the stiffener.

According to a still further embodiment, the sole includes two stiffeners laterally spaced from each other.

According to a still further embodiment, two stiffeners each of which includes first and second lateral sides, and at least a single elastically deformable element that is adjacent each of the first and second lateral sides of the two stiffeners, whereby the elastically deformable element extends from one side of the sole to the other.

According to a still further embodiment, the thickness of the elastically deformable element is less than the thickness of the sole and a support plate , which includes a first surface positioned adjacent the elastically deformable element and a second surface substantially flush with the lower surface of the sole, includes means to attach the elastically deformable element to the sole.

A further aspect of the invention is a removable end plate for the sole of a ski boot which includes at least one stiffener and at least one elastically deformable element, whereby the stiffener defines the thickness of the removable end plate, and the elastically deformable element is adapted to absorb forces encountered during skiing.

According to one embodiment, the sole includes a front zone and a rear zone and the removable end plate is adapted to be attached to the front zone and/or to the rear zone.

According to a further embodiment, the removable end plate includes a lower surface and the elastically deformable element includes a surface adapted to be located substantially flush with the lower surface.

According to a still further embodiment, the removable end plate includes at least one downwardly open cut-out, and the elastically deformable element is adapted to be located within the downwardly open cut-out.

According to a still further embodiment, the removable end plate includes an upper surface, and the elastically deformable element includes a surface adapted to be located substantially flush with the upper surface.

According to a still further embodiment, the removable end plate further includes at least one upwardly open cutout, and wherein the elastically deformable element is adapted to be located within the upwardly open cut-out.

According to a still further embodiment, the removable end plate further includes a lower surface, wherein the elastically deformable element is adapted to be sandwiched between the ski boot and the lower surface when attached to the ski boot.

BRIEF DESCRIPTION OF THE DRAWINGS

The present invention will be better understood with reference to the description which follows in connection with the schematic annexed drawings given by way of nonlimiting examples of a number of embodiments of the boot sole, in which.

DESCRIPTION OF PREFERRED EMBODIMENTS

Figure 1:
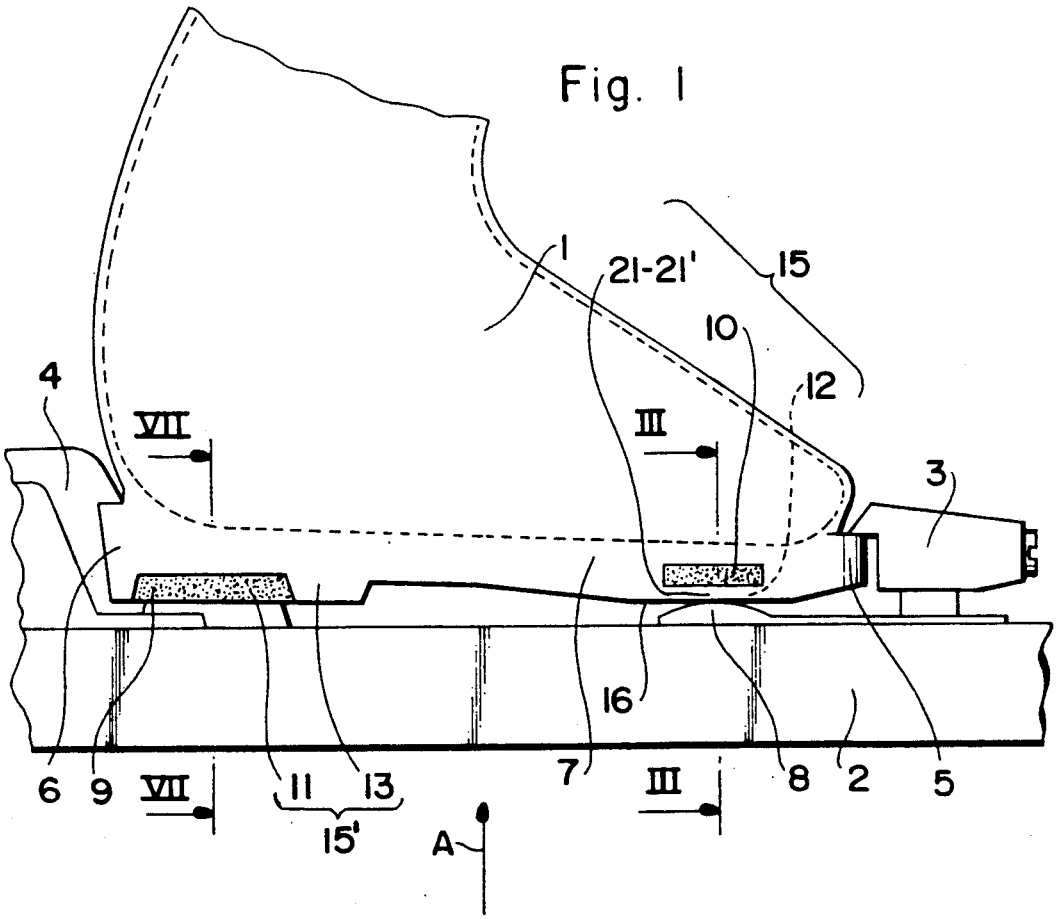
FIG. 1 schematically illustrates, in elevational view, a ski boot provided with a sole according to the invention, in the retention position on a ski, the front of the sole being provided with a shock absorption apparatus according to the first embodiment while the rear is provided with a shock absorption apparatus according to the second embodiment.

It is an object of the present invention to provide an alpine ski boot whose sole has portions with differing properties such that, at least its rigid portions enable the necessary cooperation with the ski bindings, and at least due to its elastically deformable portions, the various shocks and vibrations transmitted by the ski to the foot of the skier are absorbed.

Another object of the invention is to provide a ski boot which is likewise adapted to compensate for certain forces which result from instinctive movements of the foot of the skier in sudden and transient off-balance situations.

Another object of the present invention is to improve the skiability of the ski in the sense of being able to slide better by virtue of the major portion of residual shock and vibration forces not being absorbed by the skier himself.

This skiability is likewise increased by a better flexibility of release of the turns and steering in a curve during skiing, due to a more precise perception and control of the proportions of lateral pressures exerted at the sole of the boot.

Thus, it is an object of the invention to equip the sole of a ski boot with at least one shock absorption apparatus positioned at least in the cooperation zones of the sole with the support plates of the bindings on the ski.

The ski boot according to the invention includes a sole whose overall structure is rigid, but which is provided with at least one shock absorption apparatus situated either in the front or in the rear of the sole to cooperate with the foot support plates of the ski bindings.

This shock absorption apparatus includes, on the one hand, at least one rigid rib situated in an opening provided in the thickness of the sole, the depth of which is equal to the height of the rib, and, on the other hand, laterally to at least one of the sides of the rigid rib, an elastically deformable insert filling the opening. The rigid rib can occupy different positions with respect to the longitudinal median axis of the sole, as well as being possible with variable widths included within the width of the sole. Finally, the rigid rib can extend at least partially under the length of the sole as was briefly explained above. It is in this case preferably positioned at least in a zone corresponding to the cooperation zone with the foot support plate of the ski binding.

According to a first embodiment, the elastically deformable insert of the shock absorption apparatus is obtained by a compressible element wedged within the thickness of the sole such that the portion of the sole included between the compressible element and the walking surface of the sole has a deformable cross-section due to its reduced thickness.

According to a second embodiment of the invention, the elastically deformable insert of the shock absorption apparatus is obtained by a compressible element encased within the thickness of the rigid sole such that it is flush with the walking surface of the sole.

Each of the embodiments of the invention can be positioned both over the entire length of the sole as well as anywhere over the front and/or rear zones of the sole.

Referring to FIG. 1, a ski boot 1 is shown in a position where it is maintained on the ski 2 by means of ski bindings 3 and 4 which cooperate with the corresponding ends 5 and 6 of sole 7 resting on the ski. According to international standards the support of the sole is achieved by means of intermediate support elements 8 and 9 belonging to the bindings which cooperate with the precise contact zones situated in front or at the rear of sole 7.

Figure 2:
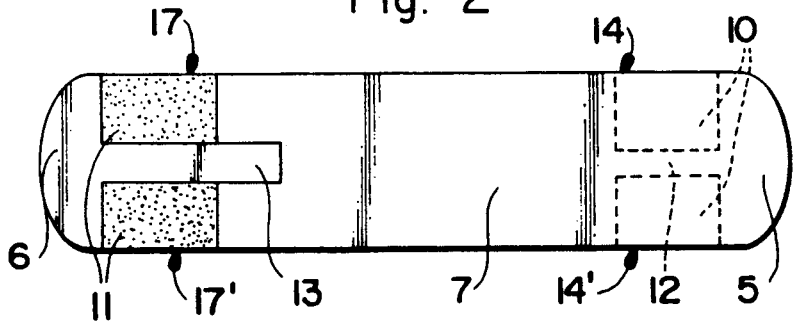
FIG. 2 is a bottom view in the direction of arrow A of FIG. 1 of the boot sole.

In the embodiment of the shock absorption apparatus 15, 15' according to FIGS. 1 and 2, sole 7 is provided with elastically deformable inserts 10 or 11 which extend on both sides of stiffeners or rigidifiers 12 and 13 situated in the longitudinal median axis of sole 7 (FIG. 2). These stiffeners 12 and 13 provide vertical support for the front zones 5 and rear zones 6 of the sole of the boot on the ski. In this way, the stiffeners define the thickness, or vertical height, of the sole under all conditions encountered during skiing. Thus, the front zone 5 of the sole fastened to the front binding 3 comprises, in the exemplary embodiment of FIGS. 1 and 2, an elastically deformable insert 10 made of a compressible material which is sandwiched in the thickness of sole 7 wherein portions 21, 21' are made deformable and, if desired, flexible, by virtue of their reduced thickness. In this way, one preserves the frictional characteristics of the lower or walking surface 16 with respect to the support element 8 while nevertheless permitting, in this zone, a certain capacity for elastic deformation of the lateral edges 14 and 14' of the sole in the direction of its thickness.

FIG. 1 also illustrates the use of a second embodiment applied to the rear of boot 1, at the rear zone 6 of the sole fastened to the binding of the rear ski binding 4. In this embodiment the elastically deformable insert 11, which is also made of a compressible material, is directly in contact with support element 9, this arrangement having no effect on the operation of binding 4, although allowing a certain capacity for elastic deformation of the lateral edges 17, 17' of the rear of the sole in the direction of its thickness.

Figure 2A:
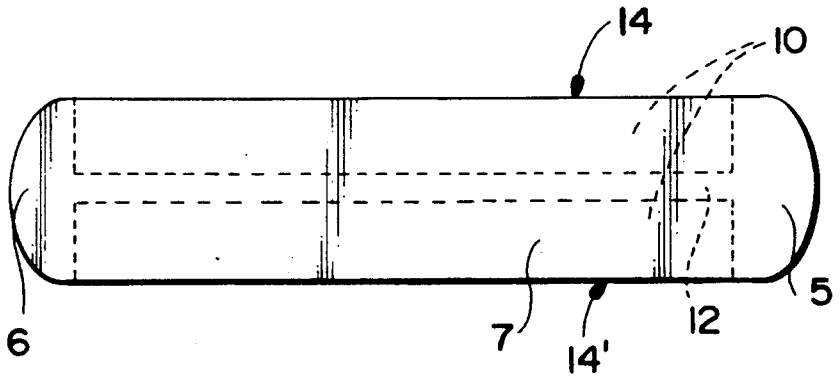
FIGS. 2*a* and 2*b* are bottom views similar to FIG. 2, illustrating alternate embodiments.
Figure 2B:
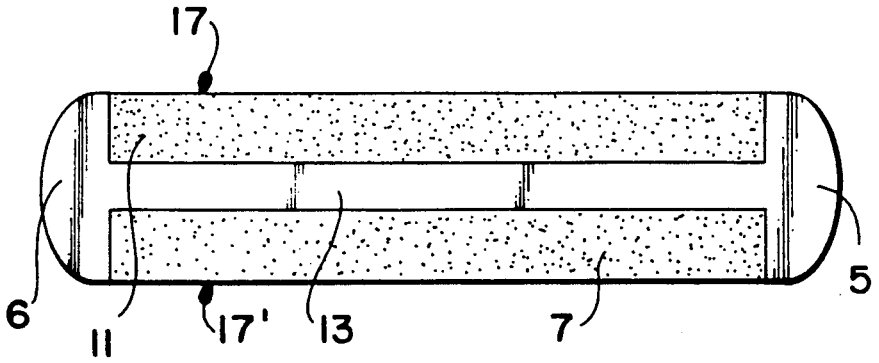

FIGS. 2*a* and 2*b* illustrate alternate embodiments, wherein the elastically deformable inserts 10 and 11, respectively, extend substantially the entire length of the sole.

Figure 3:
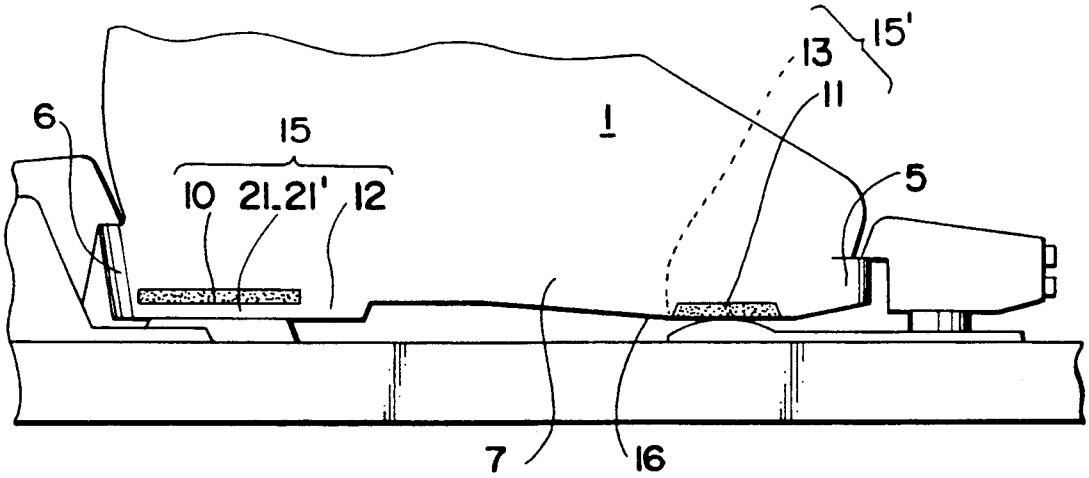
FIGS. 3–5 illustrate various embodiments of application of the first and second embodiments positioned, depending upon the figure, respectively, at the front and/or rear of the sole of the boot.
Figure 4:
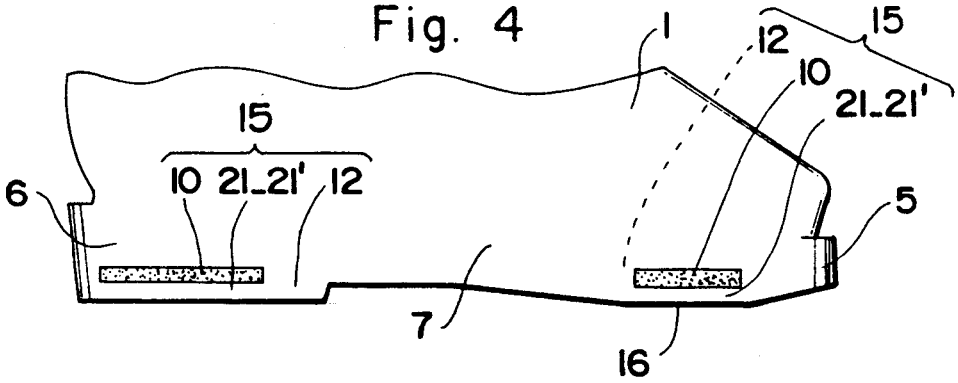
Figure 5:
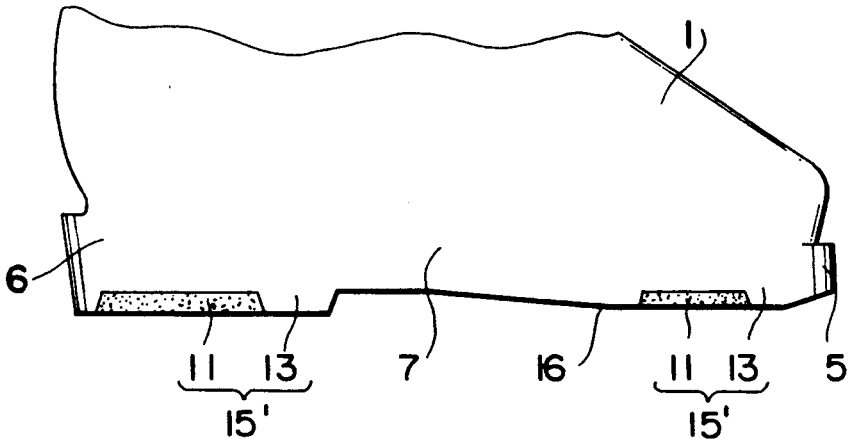

For simplicity and clarity of the drawings, the embodiments illustrated by FIGS. 3 and 5 are not shown from a bottom view of the sole. FIG. 3 shows, for example, a sole 7 having an elastically deformable insert 11 which is flush with the cuff surface of the front of the sole, while to the rear of the sole is wedged an elastically deformable insert 10 such as described as the first embodiment. FIGS. 4 and 5 illustrate the application, to each of the two ends 5 and 6 of sole 7 the same embodiment of elastically deformable insert 5 according to the object of the invention. Thus, FIG. 4 has two elastically deformable inserts 10 wedged in sole 7, while in FIG. 5 there are two elastically deformable inserts 11 flush with the walking surface. It is understood that the inserts remain connected to a rigid rib or rigidifier which guarantees the vertical support and the height of the normalized prescribed sole, thus still providing a shock absorption apparatus according to the invention.

Figure 12:
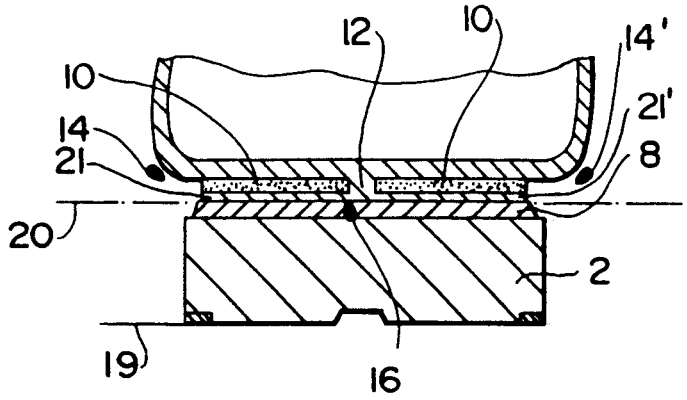
FIGS. 12 and 13 illustrate in transverse crosssectional view along line III—III of FIG. 1, the operation of the shock absorption apparatus from its rest position (FIG. 12) to an operating position as a result of a shock impacting in a direction toward the sliding plane of the ski applied at the level of one of the lateral cams (FIG. 13)
Figure 13:
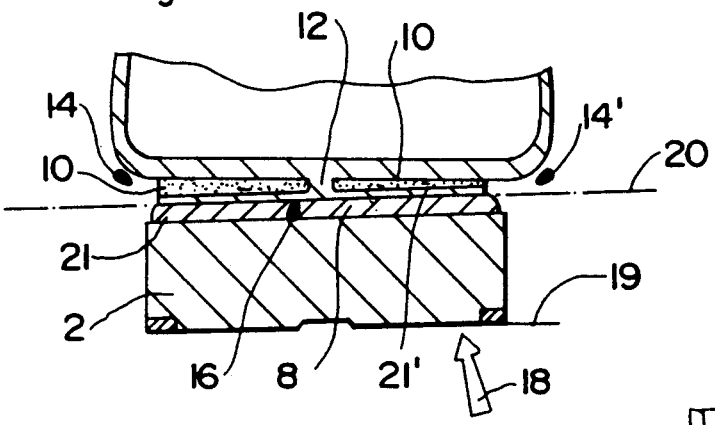
Figure 14A:
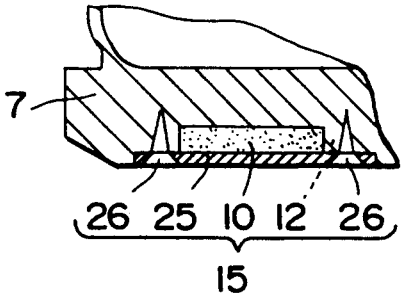
FIG. 14*a* illustrates a different embodiment of construction of the shock absorption apparatus of FIG. 4.
Figure 14:
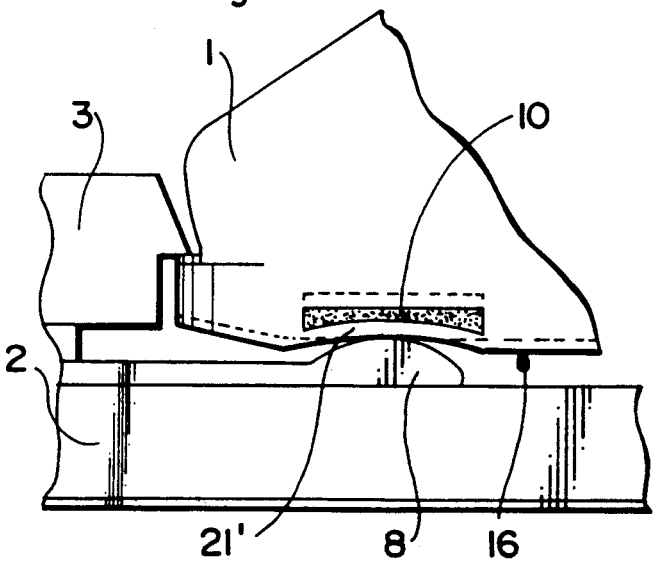
FIG. 14 illustrates, in elevational view, the shock absorption apparatus of FIG. 4.

As is seen in FIG. 12, 13, and 14, the principle of operation of the front shock absorption apparatus 15 of sole 7, during a shock or an instantaneous stress in the zone of one of the edges of the ski 2, of direction 18 which is directed toward plane 19 of the sliding surface of ski 2 (or of plane 20 of the walking surface 16 of the boot (FIG. 13)) has been schematically shown. As is seen, under the effect of the shock, the sandwich formed by the shock absorption apparatus 15 of sole 7 of the boot, support element 8, and ski 2, flexes substantially from the side corresponding to the shock by virtue, on the one hand, of the incompressibility of the rigidifier 12 of the sole which constitutes the torsion axis and, on the other hand, of the flexibility of portions 21, 21' which deform by crushing to this extent the compressible element 10 (FIG. 14).

In the embodiment shown in FIG. 14*a*, the shock absorption apparatus 15 of sole 7 includes a support plate 25 applied and embedded within the thickness of the sole by known attachment means, such as screws 26, in correspondence with compressible element 10.

Figure 15:
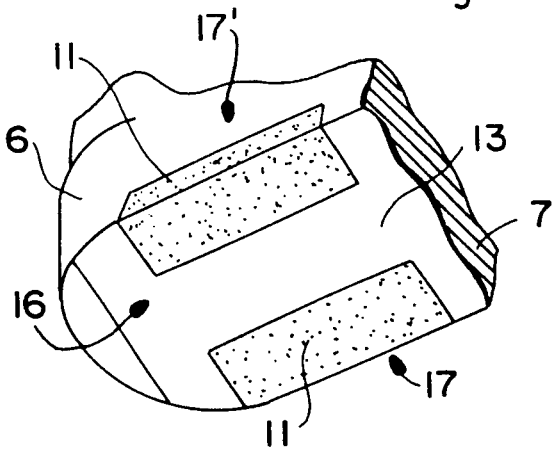
FIG. 15 is a partial perspective view of the shock absorption apparatus at the rear of the sole of the boot of FIG. 1 and shows a construction detail of the heel of the sole.
Figure 16:
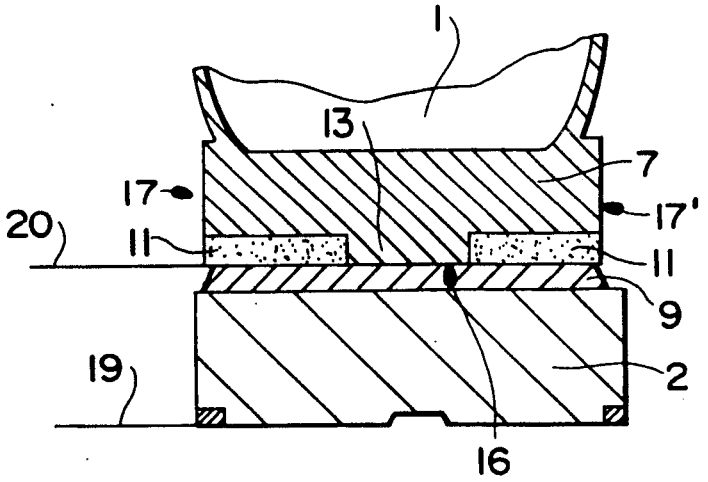
FIGS. 16 and 17 schematically illustrate, as seen in cross-section along VII—VII of FIG. 1, the rear shock absorption apparatus of the sole, at rest and in the course of operation, respectively.
Figure 17:
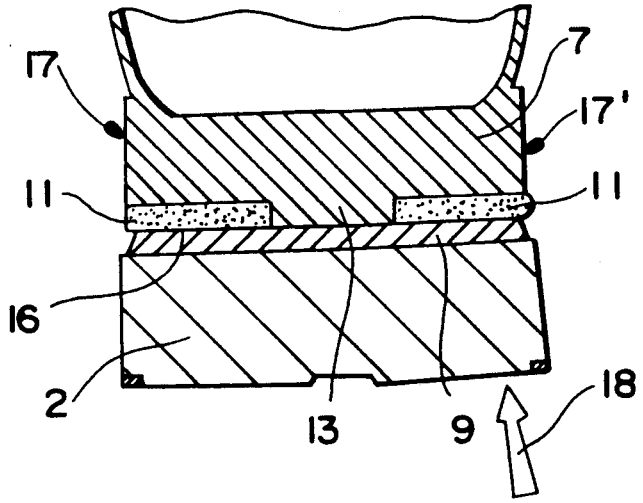

In FIGS. 15, 16, and 17 which follow, the rear zone 6, or heel of sole 7 is shown in detail. The compressible elements 11 are encased in the thickness of sole 7 and extend to the level of the walking surface 16 of which they constitute the extension. The vertical support of the rear zone 6 of the sole is assured by rigidifier 13 on support element 9. During a shock on both sides of the longitudinal axis of the ski, and having direction 18 toward plane 19 of the sliding surface of ski 2 (or plane 20 of the walking surface 16 of the boot), the boot 4 and ski 2 tend to approach one another while pivoting around rigidifier 13, which crushes to this extent compressible element 11.

Figure 18:
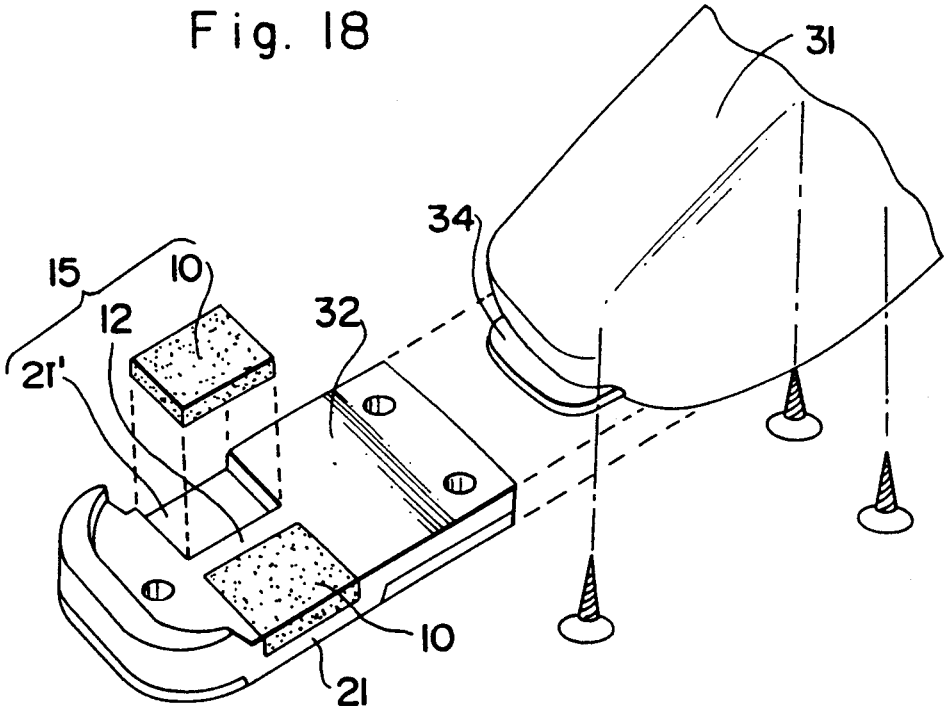
FIGS. 18, 19, 20 and 21 each illustrate one constructional embodiment of the shock absorption apparatus adapted to removable sole end plates adapted to be affixed to the front and rear of the sole.
Figure 19:
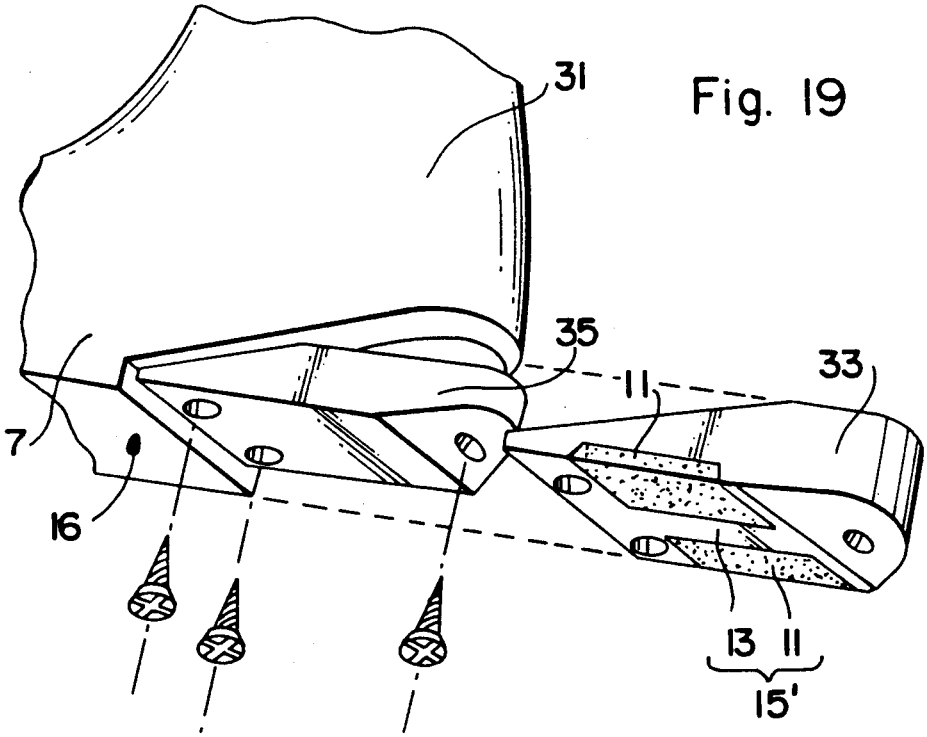
Figure 20:
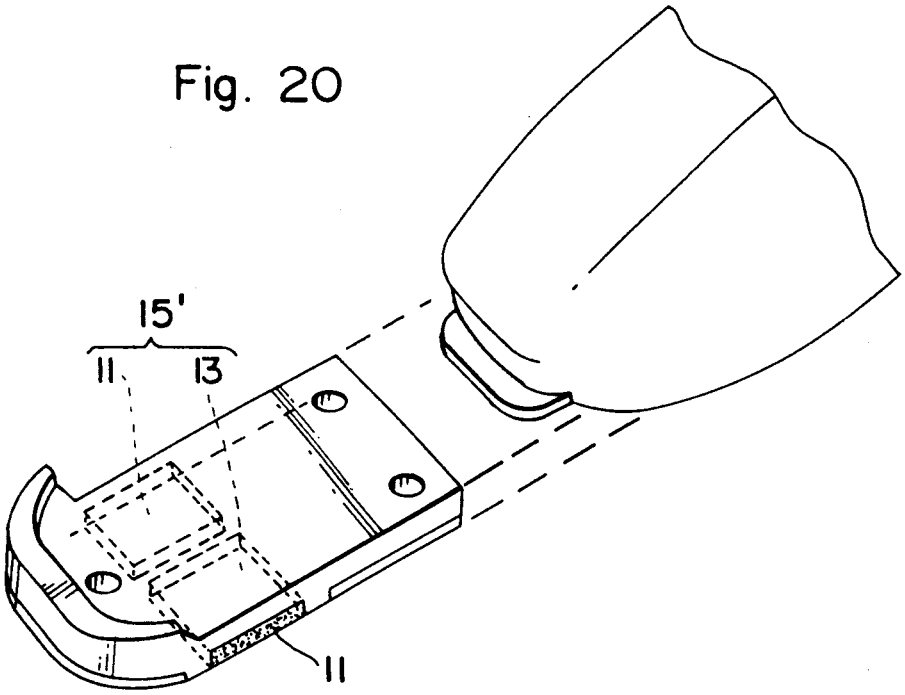
Figure 21:
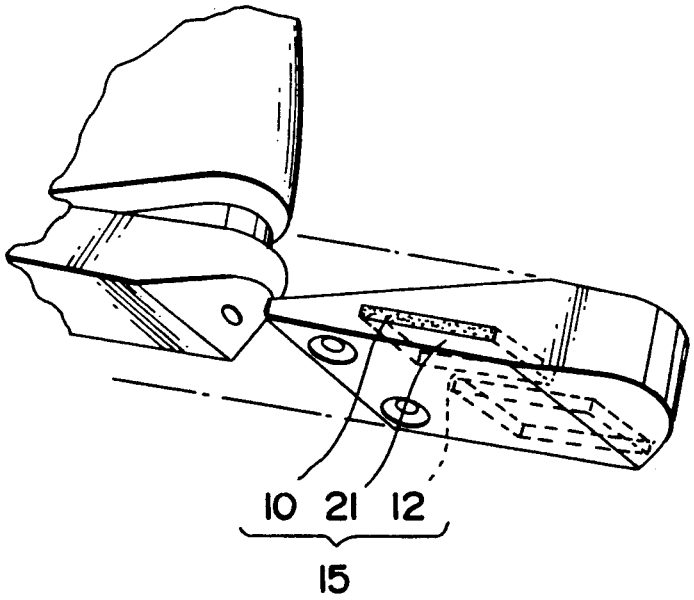

According to another embodiment, FIGS. 18, 19, 20, and 21, the sole of boot 31 is provided with removable end plates 32 and 33, respectively for the front portion 34 and rear portion 35. The compressible elements 10 and 11 of the shock absorption apparatus 15 and 15' are then integrated with each corresponding end plate. FIGS. 18 and 19 depict end plates 32 and 33 having compressible elements 10 and 11, respectively, whereas FIGS. 20 and 21 depict end plates having compressible elements 11 and 10, respectively.

The arrangement shown in FIGS. 18, 19, 20, and 21, which allows for the interchangeability of the end plates, likewise allows for the interchangeability of the deformable inserts adapted to the desired alpine skiing techniques.

Figure 7:
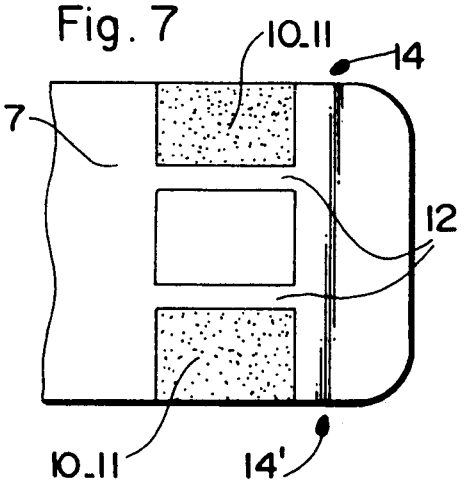
Figure 10:
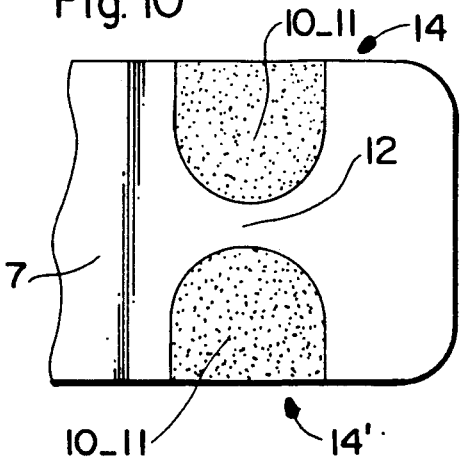

In the embodiments which have just been described the deformable inserts 10 and 11 are formed in a symmetrical fashion with respect to the rigid ribs 12 and 13. This is also the case in the examples shown in FIGS. 7 and 10 where the inserts 10 and 11 are separated by two ribs 12 (FIG. 7) spaced from one another, while in FIG. 10 inserts 10 and 11 are situated on both sides of rib 12 and have a curvilinear shape and mate with corresponding contours of sole 7.

Figure 9:
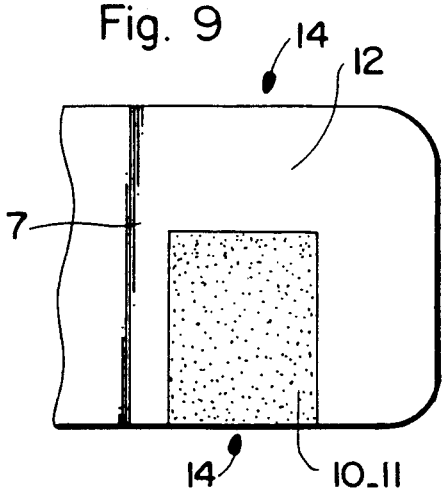
Figure 8:
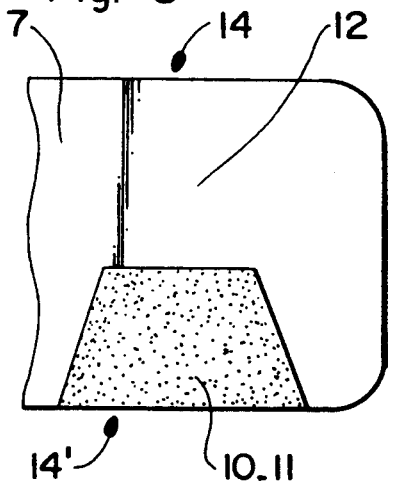

It is self evident that a single deformable insert 10 and/or 11 can be obtained on a single side of the longitudinal median axis of the sole. This type of asymmetrical construction is furthermore possible particularly between the right boot and the left boot. In effect, the forces exerted on the skis and/or boots being very often more particularly violent on the inside edge of the exterior ski during turns than on the interior ski, this latter generally being lightened, the deformable inserts can be provided essentially on the interior side of the boots. This configuration would additionally increase the skier's control of his skis through turns. It is particularly the case in the embodiments shown in FIGS. 8 and 9. In FIG. 8 the insert 10 and/or 11 extends from the lateral edge 14' of the sole, which corresponds to the interior side of the boot, to the vicinity of the longitudinal median axis of the sole. In FIG. 9 insert 10 and/or 11 extends beyond the median axis.

Figure 6:
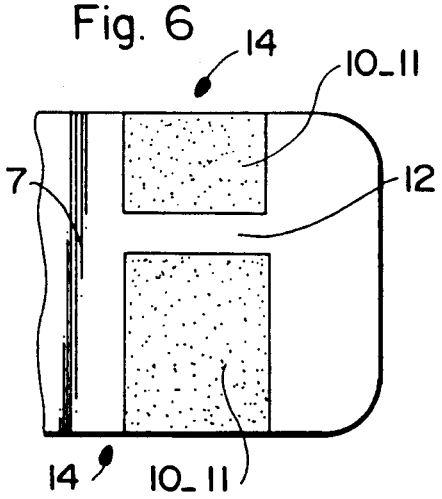
FIGS. 6 and 6*a*–11 illustrate a bottom partial view of the various arrangements of deformable elastic insert configurations with respect to one or more rigid ribs of various configurations constituting the shock absorption apparatus according to the invention.
Figure 6A:
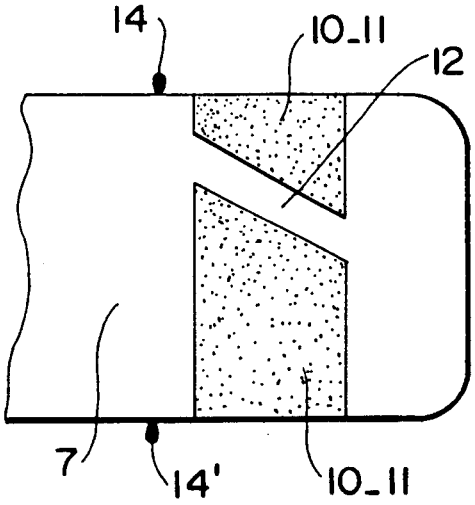

It is also conceivable (FIG. 6) to provide inserts 10 and/or 11 which extend on both sides of the sole in an asymmetrical fashion with respect to the longitudinal median axis of the latter. It is also conceivable to provide greater shock absorption for the interior side of the boot by providing a deformable insert having a greater thickness on the inside portion of the sole than the deformable insert on the outside portion of the sole, or vice versa, as shown in FIGS. 11*b* and 11*c*. Furthermore, still within the object of assuring a greater shock absorption of the interior side of the boot, the side corresponding to the edge 14 of the sole, insert 10', 11' situated on the interior side will extend on a surface greater than that of insert 10, 11 which is opposite to it. In these embodiments the rib 12 can be made substantially parallel to the longitudinal median axis of the sole. It can, however, as is shown in FIG. 6*a*, be oriented along a direction oblique to the longitudinal median axis. In such an embodiment, the stiffener provides more effective support for the boot for forces encountered and/or exerted in the direction in which the stiffener is oriented.

Figure 11:
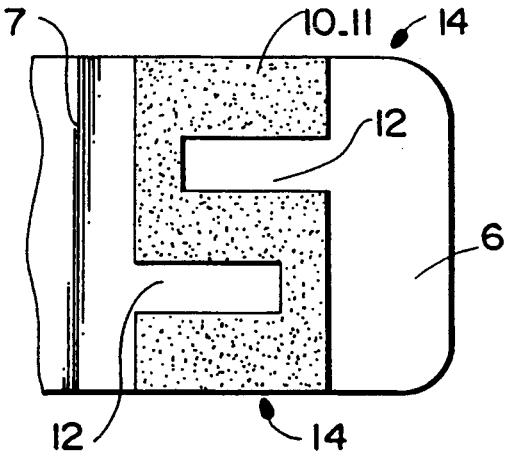

One can also provide, as shown in FIG. 11, a construction of the shock absorption apparatus such as a single insert 10, 11 which extends from edge 14 to edge 14' over the entire width of the sole, as well as so that the vertical support of the sole, constituted by rib 12, may be situated in the cooperation zone with the support plates of the bindings. In this embodiment the two rigid ribs 12 have a dimension less than the width of the deformable insert 10, 11 and extend parallel to each other and in opposite directions.

Figure 11A:
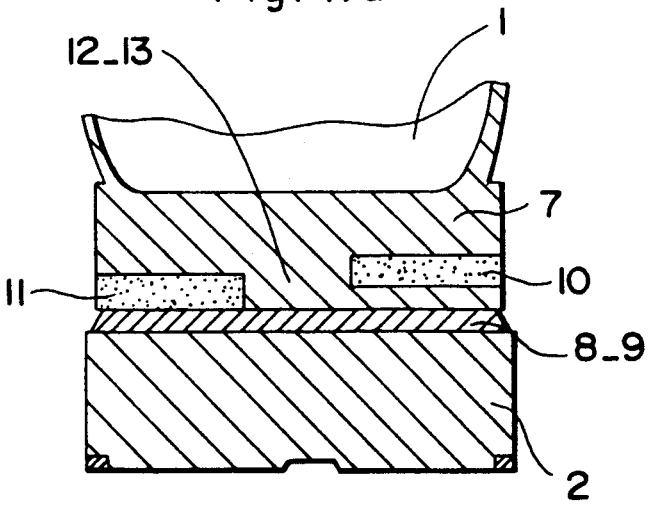
FIG. 11*a* illustrates, as seen in cross-section, the shock absorption apparatus having deformable elastic inserts of different types on different sides of the sole.
Figure 11B:
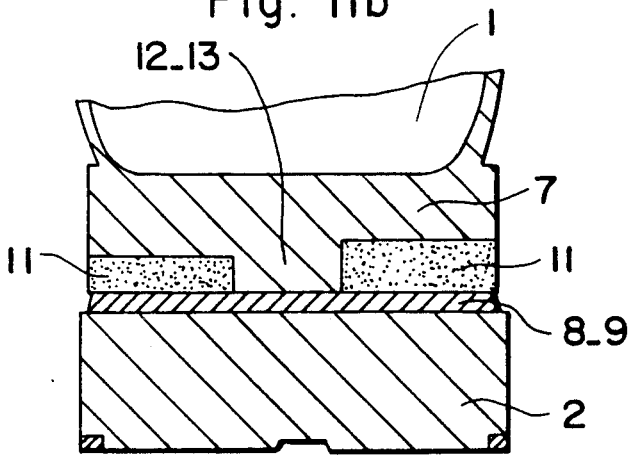
FIGS. 11*b* and 11*c* illustrate, as seen in cross-section, the shock absorption apparatus having deformable elastic inserts of different thicknesses on different sides of the sole.
Figure 11C:
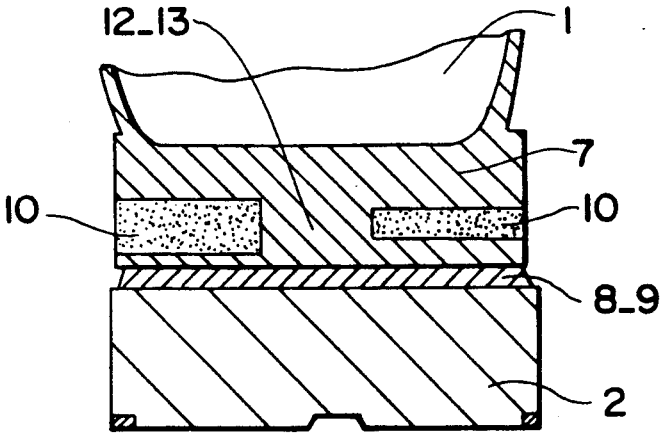

Of course one of ordinary skill in the art can combine the disclosed rib and insert configurations in various ways without going beyond the scope of the invention, but to take advantage of the properties inherent in such configurations. Likewise, it is also possible (FIG. 11*a*) to provide a shock absorption apparatus 15, 15' which combines the use of a deformable insert 11 on one side of sole 7 with a deformable insert 10 on the other side of the sole, whether as applied to the front zone or to the rear zone. Since the deformable insert 11 might tend to wear down more readily if located at certain locations of the sole, it might be considered advantageous, at such locations, to utilize deformable inserts 10. Also, as mentioned above, with inserts 10, the frictional characteristics of the lower surface 16 of the sole is made continuous and therefore is preserved.

Although the invention has been described with reference to particular means, materials and embodiments it is to be understood that the invention is not limited to the particulars disclosed and extends to all equivalents within the scope of the claims.

I claim:

1. The sole of a ski boot having a first longitudinal axis, the sole comprising:

(a) at least one rigid stiffener extending in a substantially longitudinal direction;

(b) at least one elastically deformable element located laterally adjacent said stiffener and transverse to the longitudinal direction of said stiffener;

whereby at least one stiffener defines the thickness of said sole and maintains a rigid connection with a binding under all conditions encountered during skiing, and whereby said at least one elastically deformable element is adapted to deform and thereby absorb at least lateral forces encountered during skiing when said sole pivots about said at least one stiffener.

2. The sole according to claim 1, further comprising a front support zone and said at least one elastically deformable element is located in said front support zone.

3. The sole according to claim 1, further comprising a rear support zone and said at least one elastically deformable element is located in said rear support zone.

4. The sole according to claim 1, further comprising a front support zone and a rear support zone, wherein said at least one elastically deformable element comprises at least two elastically deformable elements, and wherein an elastically deformable element is located in each of said front support zone and said rear support zone.

5. The sole according to claim 1, wherein said sole has a length, and wherein said at least one elastically deformable element extends substantially the entire length of said sole.

6. The sole according to claim 1, further comprising at least one edge and wherein said at least one elastically deformable element extends to said at least one edge.

7. The sole according to claim 1, further comprising a lower surface and wherein said at least one elastically deformable element further comprises a surface which is substantially flush with said lower surface.

8. The sole according to claim 1, further comprising a first thickness and a lower surface, wherein said at least one elastically deformable element comprises a second thickness less than said first thickness, whereby said at least one elastically deformable element is located within said sole and whereby said sole further comprises a portion located between said lower surface and said at least one elastically deformable element.

9. The sole according to claim 8, wherein said portion is flexible.

10. The sole according to claim 8, wherein said portion is deformable.

11. The sole according to claim 1, further comprising an internal side, and wherein said at least one elastically deformable element is located only on said internal side.

12. The sole element according to claim 1, further comprising an external side, and wherein said at least one elastically deformable element is located only on said external side.

13. The sole according to claim 1, wherein said at least one elastically deformable element includes an elastically deformable element on either side of a stiffener of said at least one stiffener, said elastically deformable elements having different thicknesses.

14. The sole according to claim 1, further comprising at least one support zone, and wherein said at least one stiffener comprises a single stiffener for each of said at least one support zone, and said single stiffener further comprising a second longitudinal axis, wherein said second longitudinal axis is substantially coaxial with said first longitudinal axis.

15. The sole according to claim 14, wherein said at least one elastically deformable element comprises a single elastically deformable element located at each of said at least one support zone.

16. The sole according to claim 14, wherein said at least one elastically deformable element comprises a first elastically deformable element located on one lateral side of said single stiffener and a second elastically deformable element located one a second lateral side of said single stiffener.

17. The sole according to claim 16, further comprising a lower surface, wherein said first elastically deformable element comprises a surface which is substantially flush with said lower surface, wherein said sole further comprises a first thickness, wherein said second elastically deformable element comprises a second thickness less than said first thickness, whereby said second elastically deformable element is located within said sole and whereby said sole further comprises a portion located between said lower surface and said second elastically deformable element.

18. The sole according to claim 1, wherein said at least one stiffener comprises a second longitudinal axis which is not coaxial with said first longitudinal axis.

19. The sole according to claim 18, wherein said second longitudinal axis is substantially parallel with said first longitudinal axis.

20. The sole according to claim 18, wherein said second longitudinal axis is not parallel to said first longitudinal axis.

21. The sole according to claim 19, wherein said at least one stiffener comprises at least two stiffeners laterally spaced from each other.

22. The sole according to claim 21, wherein said at least two stiffeners comprise two stiffeners each of which comprises first and second lateral sides, and wherein said at least one elastically deformable element comprises at least a single elastically deformable element that is adjacent each of said first and second lateral sides of said two stiffeners.

23. The sole according to claim 22, further comprising an inside edge and an outside edge, wherein said single elastically deformable element extends from said inside edge to said outside edge.

24. The sole according to claim 19, further comprising at least one support zone, and wherein said at least one elastically deformable element comprises a single elastically deformable element located at each of said at least one support zone.

25. The sole according to claim 19, wherein said at least one stiffener comprises a first lateral side and a second lateral side and wherein said at least one elastically deformable element comprises a first elastically deformable element located on said first lateral side and a second elastically deformable element located on said second lateral side.

26. The sole according to claim 20, wherein said at least one stiffener comprises a first lateral side and a second lateral side and wherein said at least one elastically deformable element comprises a first elastically deformable element located on said first lateral side and a second elastically deformable element located on said second lateral side.

27. The sole according to claim 1, further comprising a lower surface and a first thickness, wherein said at least one elastically deformable element comprises a second thickness less than said first thickness, whereby said at least one elastically deformable element is located within said sole, further comprising a support plate which includes a first surface positioned adjacent said at least one elastically deformable element and a second surface substantially flush with said lower surface.

28. The sole according to claim 27, further comprising attachment means to attach said at least one elastically deformable element to said sole.

29. The sole according to claim 1, further comprising at least one removable end plate, wherein said at least one stiffener and said at least one elastically deformable element are carried by said end plate.

* * * * *